United States Patent [19]

Anderson et al.

[11] Patent Number: 4,685,234

[45] Date of Patent: Aug. 11, 1987

[54] SURVEILLANCE MARKER CLIP ASSEMBLY

[75] Inventors: Philip M. Anderson, Madison; Ronald K. Reich, Florham Park, both of N.J.

[73] Assignee: Allied Corporation, Morris Township, Morris County, N.J.

[21] Appl. No.: 772,214

[22] Filed: Sep. 3, 1985

[51] Int. Cl.[4] ..... G09F 14/04

[52] U.S. Cl. ..... 40/625; 340/572

[58] Field of Search ..... 40/2, 20, 625, 626, 40/627; 340/572, 551; 292/307

[56] References Cited

U.S. PATENT DOCUMENTS

| | | | |
|---|---|---|---|
| 1,251,491 | 1/1918 | Ferriss | 40/629 |
| 1,343,837 | 6/1920 | Marr | 40/625 |
| 1,984,839 | 12/1934 | Murray | 40/625 |
| 2,100,041 | 11/1937 | Thieler | 40/626 |
| 3,493,955 | 2/1970 | Minasy | 340/572 |
| 3,806,910 | 4/1974 | Keifer et al. | 340/572 |
| 4,402,150 | 9/1983 | Sullivan | 40/615 |
| 4,510,489 | 4/1985 | Anderson | 340/572 |
| 4,560,426 | 12/1985 | Morw et al. | 340/572 |

*Primary Examiner*—Gene Mancene

*Assistant Examiner*—Wenceslao J. Contreras

*Attorney, Agent, or Firm*—Ernest D. Buff; Gerhard H. Fuchs

[57] ABSTRACT

A surveillance marker clip assembly includes a dual pin head section having a smooth pin for insertion through the article to be protected and a grooved securing pin. The grooved securing pin is positively received and maintained in a locking mechanism including a pair of latching chocks. Flanges are provided on the latching chocks. The flanges provide secure and positive edge-to-edge mating engagement with the grove of the pin so as to resist forced withdrawal of the pin and removal of the marker from the article. A spring biases the chocks into engagement with sloped inner cam surfaces of the clip assembly housing thus forcing the chocks into a closed position. A spring steel biasing element may also be provided concentrically disposed around the chocks to further maintain the chocks in the closed position. The chocks are made of soft ferromagnetic material so as to be openable for the release of the securing pin by means of an electromagnetic release mechanism positioned at the cashier counter.

14 Claims, 8 Drawing Figures

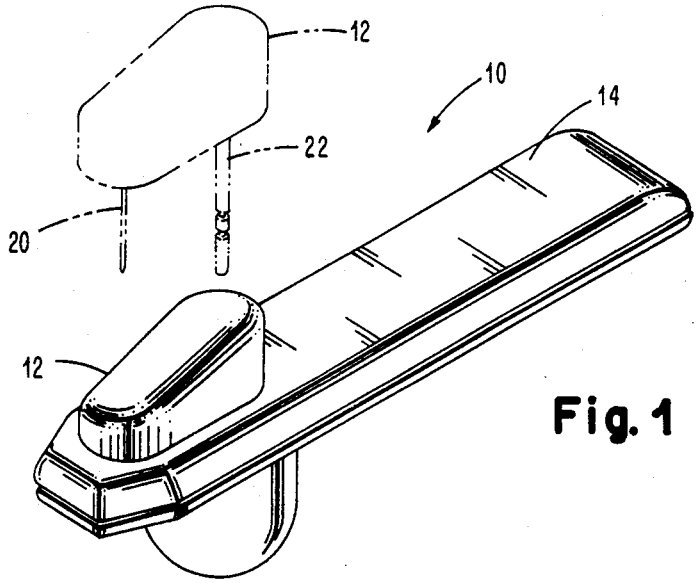
Fig. 1
Fig. 2
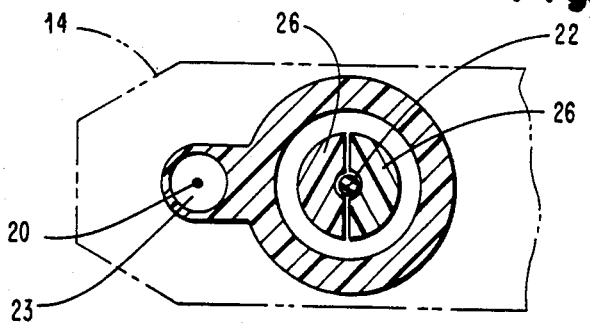
Fig. 3
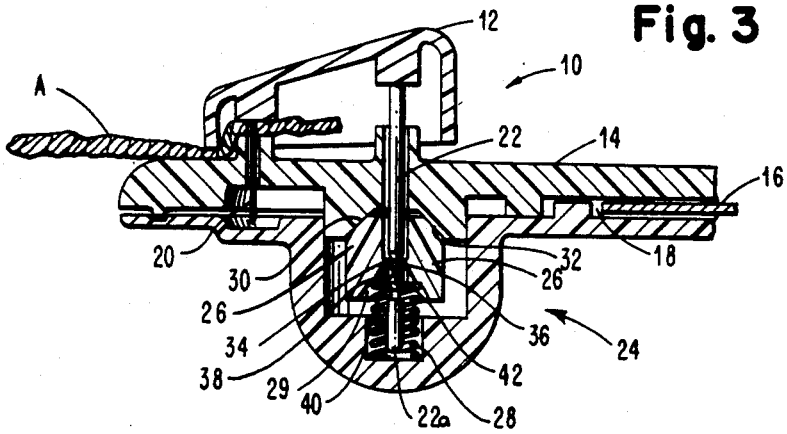

SURVEILLANCE MARKER CLIP ASSEMBLY

TECHNICAL FIELD

The present invention relates generally to article surveillance systems and markers for use therein. More particularly, the invention provides a surveillance marker clip assembly that secures the marker to an article and that may only be unlocked by a cashier or other authorized person through the utilization of a specially designed electromagnetic release apparatus.

DESCRIPTION OF THE PRIOR ART

The theft of merchandise from retail stores is a rapidly increasing problem in recent years. Thus, merchandise protection is of growing concern and importance to retailers.

Numerous technical solutions to the theft problem have been developed. Among them is the securing of an identifiable marker to an individual article of merchandise to be protected. An example of such a tagging or marking system is found in U.S. Pat. No. 4,510,489 to Anderson, III et al., entitled "SURVEILLANCE SYSTEM HAVING MAGNETOMECHANICAL MARKER" and assigned to Allied Corporation, the assignee of the present invention. The marker preferably includes an elongated, amorphous metal strip or ribbon of ferromagnetic material adapted to be magnetically biased and thereby armed to resonate mechanically at a frequency within the frequency band of a magnetic interrogation field.

A transmitting apparatus including a drive coil is situated on one side of a passageway leading to an exit from the premises. A receiving apparatus including a receive coil is positioned at the opposite side of the passageway. The drive coil sweeps through a predefined spectrum of frequencies including the resonant frequency of the target ribbon of the marker.

As the drive frequency passes through the resonant frequency of the marker ribbon, the marker generates a distinctive increase in the voltage induced in the receive coil. This marked effect upon the fundamental frequency of the induced voltage allows simple and accurate marker detection even in the presence of other objects. Of course, detection indicates that the marker has not been properly deactivated or removed from the marked article by the cashier and, therefore, that the article is not properly checked out and/or purchased.

As should be appreciated, in order to prevent theft, markers of this type must be very difficult for a potential shoplifter to remove from the article. Conversely, however, the markers must be easy to release for authorized store personnel such as the cash register attendant who removes the markers from purchased merchandise so as to allow the passage of merchandise from the premises without the sounding of an alarm. Thus, it is clear that a marker should be designed for release from an article only by means of a specially designed apparatus or tool only in the possession of authorized store personnel.

Marker fastening mechanisms that may only be released by means of a specially designed mechanical release apparatus are still, however, subject to problems. Typically, such mechanical release devices are small, hand-held tools subject to being copied or stolen. The thief may then use the copied or stolen tool to remove markers from the store merchandise and then steal the merchandise at will without sounding the marker actuated alarm.

In order to overcome this problem, the marker locking or fastening mechanism should only be releasable by means of a specially designed electro-magnetically powered release apparatus that must be plugged into an electrical outlet. Such an apparatus or device is not subject to being stolen and used by a thief and, of course, may be conveniently positioned next to the cash register at the check-out counter to remove markers from purchased goods.

U.S. Pat. No. 3,858,280 to Martens et al. discloses a marker fastening clip that may be released by an electro-magnetically powered tool. The fastening clip includes retaining balls that engage a smooth pin extending through and connecting the marker and the article to be protected. The Martens fastener, however, is not without its disadvantages.

Specifically, the retaining balls and smooth pin structure fail to provide the necessary positive engagement capable of resisting the forced withdrawal of the pin and, therefore, the removal of the marker from an article by a thief. A need is, therefore, identified for a new and improved marker fastening mechanism providing secure locking engagement to an article while allowing ease of removal only by an authorized person with a specially designed electro-magnetically powered release device.

SUMMARY OF THE INVENTION

The present invention provides a surveillance marker clip assembly capable of providing secure locking engagement between the marker and an article to be protected. Advantageously, the clip assembly provides positive locking action through edge-to-edge engagement between a pair of latching chocks and a securing pin that passes through the clip assembly. Specifically, a flange on each latching chock is received within and engages a groove on the securing pin. The resulting secure edge-to-edge engagement between the pin groove and the chock flanges provides positive resistance to the forced withdrawal of the pin and, therefore, to the removal of the surveillance marker from the article. Thus, the present invention provides improved protection against merchandise theft.

The latching chocks are biased to the closed position to engage the securing pin and promote the positive locking action. Specifically, the latching chocks include wedging cam surfaces and cooperating cam surfaces are provided along an inner portion of the housing. A spring biases the latching chocks so that the wedging cam surfaces of the chocks engage the inner cam surfaces of the housing. This engagement serves to press the latching chocks together tightly around the securing pin. An additional spring steel element may be concentrically disposed around the latching chocks to further urge the chocks tightly together.

Preferably, the groove of the securing pin includes a retaining surface on the side of the groove closest to the pin tip and an inserting cam surface on the other side furthest from the pin tip. The groove retaining surface extends at an angle substantially perpendicular with respect to the longitudinal axis of the pin so as to positively engage the latching chock flanges and resist forced pin withdrawal. Conversely, the inserting cam surface of the groove slopes gently at an acute angle relative to the longitudinal axis of the pin so as to allow the smooth insertion of the pin between the latching chocks as well as efficient authorized removal of the pin as desired.

Preferably, the latching chocks are formed of hard material, that resists deformation and chipping, having soft ferromagnetic properties for electro-magnetic actuation by a specially designed apparatus that may, for example, be secured next to the cash register at the check-out counter. Such a release mechanism is not likely to be stolen and used by the thief to remove markers from articles that may then be stolen at will. A release mechanism or system of this type is fully disclosed in copending application entitled Pulsed Magnetic Release Mechanism (SN772,213, U.S. Pat. No. 4,651,136 and incorporated herein by reference.

The marker is also designed to assure release of the securing pin when the release mechanism is activated to draw the latching chocks into the open position. Specifically, the head section of the housing holding the securing pin includes a lower edge cut at an angle other than perpendicular to the securing pin. Thus, as the head section and securing pin are pushed or drawn down toward the body section of the housing containing the locking mechanism during pin removal, the securing pin is tilted or pivoted toward one of the latching chocks. Advantageously, this tilting or pivoting frees the flanges of the chocks from catching on the edge of the groove of the securing pin and assures chock opening and, therefore, pin removal with the electro-magnetic release mechanism.

BRIEF DESCRIPTION OF THE DRAWING

The accompanying drawing incorporated in and forming a part of the specification, illustrates several aspects of the present invention, and together with the description serves to explain the principles of the invention. In the drawing:

FIG. 1 is a perspective view of the surveillance marker clip assembly of the present invention showing the head and body sections of the housing connected together (note full line) and the head section detached from the body section (note dashed line);

FIG. 2 is a cross-sectional view through the clip assembly locking mechanism of the present invention;

FIG. 3 is another cross-sectional view through the clip assembly locking mechanism of the present invention showing the head and body sections of the housing connected together and locked with the latching chocks in a closed position;

DETAILED DESCRIPTION OF THE PRESENT INVENTION

Figure 4:
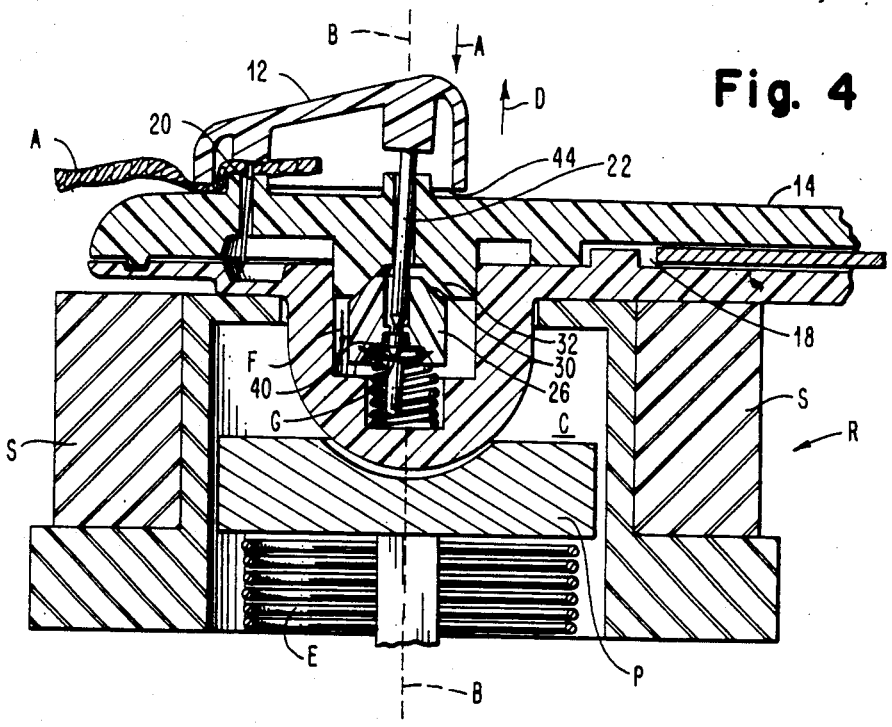
FIG. 4 is a cross-sectional view similar to FIG. 3 showing the surveillance marker clip assembly during the initial stages of opening the latching chocks through the use of an underlying electromagnetic release mechanism.

Reference is now made to FIG. 1 showing the surveillance marker clip assembly 10 of the present invention. The marker assembly 10 is adapted for securely fastening to a cloth article, such as shown at A in FIG. 3, to allow surveillance or identification of that article.

Specifically, the marker assembly 10 includes a housing having a head section 12 and a body section 14. The body section 14 contains, for example, one or more signal-producing ribbons 16 in a housing cavity 18. Preferably, each ribbon 16 is a strip of amorphous magnetostrictive ferromagnetic material adapted to the magnetically biased and, thereby, armed to resonate mechanically at a standard or known frequency to generate an identifiable signal. The magnetic biasing may be provided by a separate ferromagnetic slab or plate (not shown) of high magnetic coercivity positioned adjacent the ribbon 16 or by impregnating the plastic housing with barium ferrite. The latter alternative is discussed in detail in U.S. patent application entitled CODED SURVEILLANCE MARKER WITH IMPROVED BIASING SN U.S. Pat. No. 772,215, Pending, and incorporated herein by reference.

In accordance with the present invention, the marker assembly 10 is positively attached to the article A to be protected, and is designed to prevent unauthorized or forced removal. Further, the marker does not damage the article A when attached or removed, for example, by a stock person or a cashier.

Specifically, the marker assembly 10 is securely fastened to the article by a dual pin fastening structure on the head section 12. The head section 12 includes a smooth pin 20 and a grooved securing pin 22. The smooth pin 20 is pressed through the article A to which the marker assembly 10 is to be fastened and received in pin receiving aperture 23 in the body housing section 14. As this is done, the grooved securing pin 22 is inserted into a releasable locking mechanism in the body housing section 14, generally designated by reference numeral 24 and described in detail below. The advantages and additional details of the dual pin locking structure are fully set forth in copending patent application Ser. No. 737,318, filed May 23, 1985, entitled DUAL PIN FASTENER and incorporated herein by reference Superior retention and securing of the head and body sections 12, 14 together as well as the marker assembly 10 to the article A is provided by means of positive mating edge-to-edge engagement between the grooved pin 22 and a pair of semicircular latching chocks 26.

As shown the chocks 26 are biased together to a closed position by means of a spring 28. Specifically, the spring 28 biases the chocks 26 upwardly as shown in FIG. 3 so the substantially conical wedging cam surfaces 30 on the chocks are brought into mating engagement with cooperating inner cam surfaces 32 of the body housing section 14. As shown, the spring 28 may be received in a recess 29 formed in the bottom of the chocks 26 to assure proper alignment of the system components at all times.

As should be appreciated, the inner cam surfaces 32 of the housing taper away from the securing pin 22 and engage the sloped cam surfaces 30 of the chocks 26 to force the chocks together. Advantageously, any attempt to forceably withdraw the pin 22 from the locking mechanism 24 is, therefore, resisted by a proportionally increased pressure to close the chocks 26 around the pin from this wedging action of the cam surfaces 30, 32.

When in the closed position, inwardly extending flanges 34 on the chocks 26 are received within the groove 36 of securing pin 22. As shown in FIG. 3, the groove 36 includes a retaining surface 38 on the side of the groove closest to the pin tip 22*a* that extends at a substantially right angle with respect to the longitudinal axis of the pin 22. The flange 34 of each latching chock 26 includes a substantially parallel mating surface 40 to provide positive and secure mating edge-to-edge engagement between the locking mechanism chock and the pin. Thus, forced withdrawal of the pin is effectively resisted.

As shown, the securing pin 22 may include more than one groove to allow proper attachment of the assembly 10 to articles A of different thickness. In order to allow for smooth insertion of the pin 22 in the locking mechanism 24, the side of each groove 36 furthest from the tip 22*a* of the pin includes a sloped inserting cam surface 42. The slope of the surface 42 allows the pin 22 to separate the chocks 26 for further insertion into the body housing section 14 with the chock flanges 34 sliding up the side of the pin until reaching the next groove 36. Upon reaching the next groove 36, the chocks 26 close under the combined biasing of the spring 28 and engagement of the wedging cam surfaces 30 and 32 to again provide secure and positive edge-to-edge locking engagement.

Of course, it should be appreciated that any attempt to remove the pin 22 from the locking mechanism by pushing the pin further down into the body housing section 14 will be unsuccessful. The flanges 34 of the chocks 26 will simply slide from the groove 36 up the sloped inserting cam surface 42 and along the shaft of the pin 22. As soon as any attempt is made to then pull the pin 22 from the locking mechanism, the chocks slide back down the shaft of the pin and close under the biasing action of the spring 28 and wedging action of the cam surfaces 30 and 32 so that the chock flanges 34 are again in secure engagement with the mating retaining surface 38 of the groove.

Figure 5:
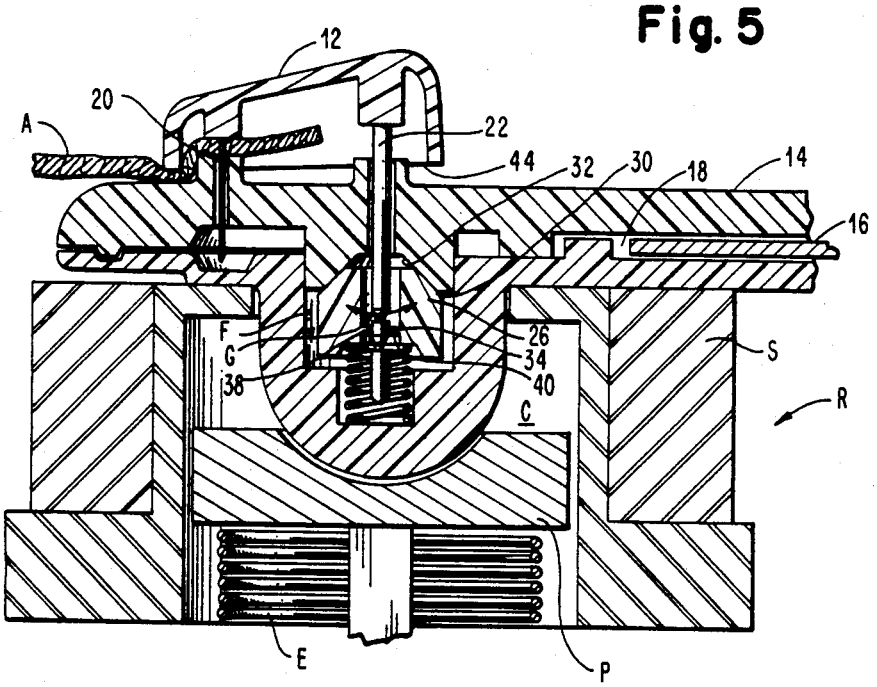
FIG. 5 shows the latching chocks completely opened and the securing pin released for separating the head and body housing sections and removing the surveillance marker clip assembly of the present invention from the article.

Thus, it should be appreciated that a special tool or mechanism is required for releasing the securing pin 22 from the latching chocks 26. The latching chocks 26 are formed of a hard material (to prevent damage during forced pin removal) with soft ferromagnetic properties so that they may be easily separated for pin removal by authorized personnel using a specially designed electromagnetic device that may conveniently be located near the check-out counter. Such a release device requiring power from an electrical outlet is described in detail in the previously referenced copending U.S. patent application entitled Pulsed Magnetic Release Mechanism (SN 772,213 U.S. Pat. No. 4,651,136) and already incorporated herein by reference. As shown in FIGS. 4 and 5, the latching chocks 26 are displaced to an open position by inserting the portion of the housing containing the lock mechanism 24 into a central core C of a solenoid coil S of the release mechanism R. In particular, as the locking mechanism 24 is inserted into the central core C, a downward force (note action arrow A in FIG. 4) is exerted on the head section 12. This causes the securing pin 22 to be extended further into the locking mechanism 24 with the sloped inserting cam surface 42 of the groove 36 separating the chocks 26. Thus, the flanges 34 of the chocks 26 are free of the groove 36 so as to prevent the mating surface 40 of the chocks 26 from hanging on the retaining surface 38 of the pin groove 36 and resisting separation of the chocks by the electromagnetic release mechanism R.

Additionally, it should be appreciated that the lower edge 44 of the head section 12 is cut at an acute angle away from the body section 14 so as to cause the securing pin 22 to tilt or pivot from the perpendicular (note dashed line B—B). This further serves to free the flange 34 of the right hand chock 26 in FIG. 4 from the groove 36 of the pin 22 so that when the solenoid coil S of the release mechanism R is activated, the chocks 26 are sure to pull free of the groove and open. Of course, it should be recognized that any attempt to forcibly withdraw the pin 22 from this position will fail. Any movement of the head section in the direction of the arrow D without the opening of the chocks using the release mechanism will cause the securing pin 22 to return to a perpendicular orientation along line B—B with the flanges 34 of both chocks firmly and positively engaging the mating groove retaining surface 38 of the securing pin.

As the lock mechanism 24 is inserted into the core C, the housing engages the piston P and forces it downward against the action of biasing spring E. Once the housing and lock mechanism 24 is completely inserted in the central core C, the piston P activates the solenoid coils through a switch (not shown). The magnetic field created by the activated coil S serves to pull the chocks 26 down against the biasing spring 28 and apart (note arrows F and G in FIG. 5). Thus, the flanges 34 of the chocks 26 are pulled away and freed from the securing pin 22. Consequently, the pin 22 may be withdrawn from the locking mechanism 24, the head and body housing sections 12 and 14 separated and the marker 10 removed from the article A. It should also be appreciated that none of the clip assembly components are damaged in removal and the assembly may be reused, for example, by the store to mark another article.

Figure 6:
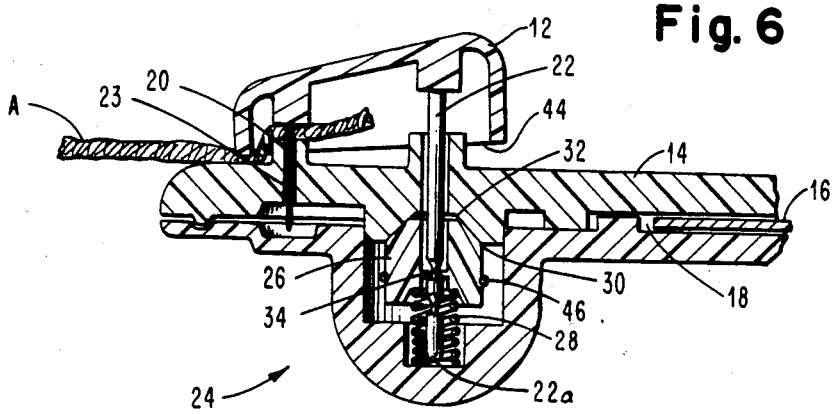
FIG. 6 is a cross-sectional view similar to FIG. 3 showing an alternative embodiment of the present invention with the latching chocks in the closed position for locking the head and body housing sections together and the clip assembly to the article.
Figure 7:
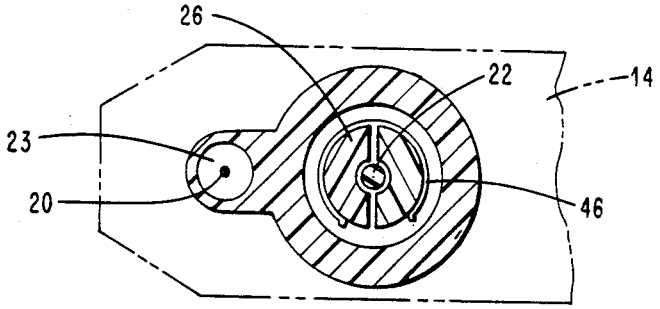
FIG. 7 is an additional cross-sectional view of the alternative embodiment shown in FIG. 6 with the latching chocks in the closed position.
Figure 8:
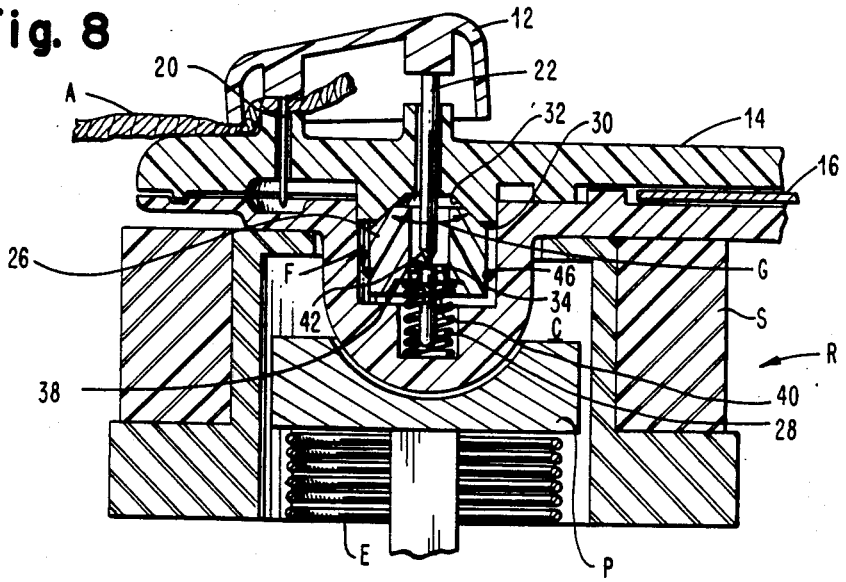
FIG. 8 is a cross-sectional view similar to FIG. 6 but showing the latching chocks in the open position for the separation of the head and body housing sections and the removal of the surveillance marker clip assembly.

An alternative embodiment of the locking mechanism 24 of the clip assembly 10 of the present invention is shown in FiGS. 6–8. Specifically, an additional spring steel biasing element 46 is provided concentrically disposed around the chocks 26. The element 46 provides a biasing force for maintaining the chocks 26 in a closed position in addition to the force provided by the wedging action between the cam surfaces 30 and 32 in the previously described embodiment. Advantageously, it should be appreciated that this force is constantly applied to the chocks 26 even when the chocks are being pushed against the biasing spring 28 away from the inner cam surface 32 of the body housing section 14. Thus, positive edge-to-edge engagement between the mating surfaces 40 of the chock flanges 34 and the groove retaining surface 38 of the securing pin 22 is assured at all times.

Operation and opening of the alternative locking mechanism 24 using the release mechanism R is essentially the same as described above. The locking mechanism 24 is inserted into the central core C of the release mechanism R. The piston P activates the solenoid coil S that draws the chocks 26 down in the direction of arrow F against the force of biasing spring 28 and open or out in the direction of arrow G against the force of the spring steel biasing element 46. Again, in this embodiment the angled lower edge 44 of the head section 12 causes the pin to initially tilt or point away from the perpendicular to assure that the chock flanges 34 do not hang in the pin groove 32 and prevent pin removal when the magnetic release mechanism R is used to release the pin. The securing pin 22 is thus free for withdrawal from the locking mechanism 24 and for removal of the marker 10 from the article A following release mechanism R activation.

In summary, numerous benefits result from employing the concepts of the present invention. In providing a marker clip assembly 10 with positive edge-to-edge locking engagement between flanges 34 of cooperating latching checks 26 and a groove 36 on a securing pin 22, forced removal of a surveillance marker from an article by a thief is substantially eliminated. Further, since the chocks are openable by an electromagnetic release mechanism that must be connected to an electrical outlet, the feasibility of stealing the tools for releasing the markers is essentially eliminated.

The foregoing description of the preferred embodiments has been presented for purposes of illustration and description. It is not intended to be exhaustive or to limit the invention to the precise form disclosed. Obvious modifications or variations are possible in light of the above teachings. The embodiments were chosen and described simply to provide the best illustration of the principles of the invention and its practical application to thereby enable one of ordinary skill in the art to utilize the invention in the various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A surveillance marker clip assembly or the like used in marking articles, comprising:

a housing;

securing means for attaching the clip assembly to the article;

positive lock means in said housing for receiving said securing means, said lock means being displaceable between an open position allowing release of the securing means and a closed position for locking;

mating edge means on said securing means and lock means for retaining the securing means with edge-to-edge engagement that resists withdrawal; and means for biasing said lock means to the closed position.

2. The clip assembly recited in claim 1, wherein said positive lock means includes a pair of latching chocks.

3. The clip assembly recited in claim 2, wherein each latching chock is formed of a hard material having soft ferromagnetic properties for electromagnetic actuation.

4. The clip assembly recited in claim 3, wherein each latching chock is substantially semicircular in plan.

5. The clip assembly recited in claim 2, wherein said mating edge means includes a flange on each latching chock and a cooperating groove on said securing means, said flange of each chock being received in said groove when said latching chocks are in the closed position so as to provide secure edge-to-edge engagement that resists withdrawal.

6. The clip assembly recited in claim 5, wherein said securing means comprises a grooved securing pin.

7. The clip assembly recited in claim 6, wherein said groove includes a retaining surface on one side extending at a substantially right angle with respect to said pin for engaging said flange of each chock and providing secure edge-to-edge engagement that resists pin withdrawal and an inserting cam surface on a second opposite side that allows the pin to be smoothly inserted into the latching chocks.

8. The clip assembly recited in claim 1, wherein said housing includes an inner cam surface tapering away from said securing means and said positive lock means includes a wedging cam surface for mating with said inner cam surface, whereby resulting wedging action during any attempted forced removal of the securing means assures that the mating edge means are positively engaged.

9. The clip assembly recited in claim 8, wherein said biasing means engages said positive lock means opposite said wedging cam surface and biases said positive lock means toward engagement with said tapered inner cam surface of said housing to bring said positive lock means to the closed position.

10. The clip assembly recited in claim 8, wherein said wedging cam surface of said positive lock means is substantially conical.

11. The clip assembly recited in claim 8, wherein said biasing means is substantially concentrically disposed around said positive lock means urging said lock means into edge-to-edge engagement with said securing means.

12. The clip assembly recited in claim 6, wherein means are provided for tilting the grooved securing pin during authorized release by electromagnetic actuation of said latching chocks, the tilting substantially eliminating any possibility of the flanges of said latching chocks hanging in said groove of said securing pin.

13. The clip assembly recited in claim 12, wherein said grooved securing pin is attached to a head section of said housing and said latching chocks are contained in a body section of said housing; said tilting means comprising a lower edge of said head section being cut at an angle other than perpendicular to said securing pin so that as said lower edge is brought into engagement with said body housing section, said securing pin is tilted away from a substantially perpendicular line toward one of said latching chocks.

14. The clip assembly recited in claim 11, wherein said substantially concentrically disposed biasing means is a spring steel ring element.

* * * * *